US008869312B2

(12) United States Patent
Tuohy et al.

(10) Patent No.: US 8,869,312 B2
(45) Date of Patent: Oct. 28, 2014

(54) MATERIALS AND METHODS FOR A HAT WITH INTERCHANGEABLE LOGO

(71) Applicants: Joshua D. Tuohy, McLean, VA (US); Taylor M. Bush, Chevy Chase, MD (US)

(72) Inventors: Joshua D. Tuohy, McLean, VA (US); Taylor M. Bush, Chevy Chase, MD (US)

( * ) Notice: Subject to any disclaimer, the term of this patent is extended or adjusted under 35 U.S.C. 154(b) by 0 days.

(21) Appl. No.: 14/167,511

(22) Filed: Jan. 29, 2014

(65) Prior Publication Data

US 2014/0208483 A1 Jul. 31, 2014

Related U.S. Application Data

(60) Provisional application No. 61/758,034, filed on Jan. 29, 2013.

(51) Int. Cl.
*A42B 1/24* (2006.01)
*A42B 1/00* (2006.01)

(52) U.S. Cl.
CPC ..... *A42B 1/004* (2013.01)
USPC ..... 2/209.13

(58) Field of Classification Search
USPC ..... 2/209.13, 171.4, 171.5, 181.2, 181.4, 2/244, 195.2, 195.3, 195.4
See application file for complete search history.

(56) References Cited

U.S. PATENT DOCUMENTS

| | | | | |
|---|---|---|---|---|
| 5,359,734 | A | 11/1994 | Rathburn | |
| 5,418,981 | A * | 5/1995 | Miner | 2/209.13 |
| 5,632,047 | A * | 5/1997 | Van Den Heuvel | 2/209.13 |
| 5,924,139 | A * | 7/1999 | Van Den Heuvel | 2/209.13 |
| 6,519,779 | B1 | 2/2003 | Taguchi | |
| 8,474,064 | B2 * | 7/2013 | Hardy, III | 2/209 |

* cited by examiner

*Primary Examiner* — Tejash Patel
(74) *Attorney, Agent, or Firm* — Patterson Thuente Pedersen, P.A.

(57) ABSTRACT

The present invention relates generally to the materials and methods for an improved baseball style cap, wherein the logo is detachable and interchangeable with other logos. Generally, the present invention is advantageous because it allows the wearer to have the option of using a single hat capable of displaying an array of different logos. The interchangeable logo can be attached to a hat using an attachment mechanism such as a seal. The logo can also comprise a looped tab that facilitates its removal and storage.

20 Claims, 8 Drawing Sheets

MATERIALS AND METHODS FOR A HAT WITH INTERCHANGEABLE LOGO

RELATED APPLICATION

The present application claims the benefit of U.S. Provisional Application No. 61/758,034 filed Jan. 29, 2013, and entitled "MATERIALS AND METHODS FOR HAT WITH INTERCHANGEABLE LOGO", which is incorporated herein in its entirety by reference.

FIELD OF THE INVENTION

The present invention relates generally to the field of wearable clothing including logos or brand identifiers. More specifically, the present invention relates to materials and related methods for a baseball style cap, wherein the logo or brand identifier is detachable and interchangeable with other logos and brand identifiers.

BACKGROUND OF THE INVENTION

The use of hats to advertise or promote an affiliation with or a display a wearer's allegiances (e.g., products, companies, sports teams, political slogans, etc.) is common, especially using baseball style caps. Generally, the wearer conveys the advertisement, logo or message in the form of a logo or other symbolism that adorns the front of the hat so as to be noticeable to a viewer. The logo or symbol conveying the advertisement or message can be of various shapes, sizes, colors, and dimensions, and it can contain words, pictures, symbols, emblems or combinations thereof, depending on the content and style of the message or advertisement.

While conveying a message or advertisement through the logo on a baseball style cap is generally effective, there are disadvantages. Given the costs and limitations of manufacturing, only one logo per hat is typically used to convey a particular advertisement or message. Additionally, advertisers want to convey a simple and direct message with a single logo, as multiple logos could confuse the viewer or confuse the intent of the wearer. Generally, these limitations therefore require a wearer to purchase multiple hats, with each individual hat corresponding to every different message or advertisement that the wearer wants to convey. In the case of higher quality fitted hats, this can require a significant investment on the part of the wearer to accumulate individual hats for all of their various interests. As such, it would be advantageous to have a hat design that overcame the need for a wearer to invest in individual hats for each of their interests.

SUMMARY OF THE INVENTION

The present invention is directed to materials and methods related to a baseball style cap, wherein a logo is detachable and interchangeable with other logos. The baseball style cap of the present invention provides for the wearer to have a single hat wherein the logo can be detached and replaced with another logo, without the wearer comprising fit or aesthetics.

In one aspect, the present invention is directed to a hat wherein a logo can be attached to the front panels of a baseball style hat. For example, the logo can be centered between the front two panels, or the logo can be off-center and attached to either the right or left front panel of the hat. In another aspect, the logo can be attached so that it is centered between the right or left side panels, or centered between the back panels. The logo can also be off-center and attached to only one of the right, left, or back panels. It some embodiments, more than one logo may adorn the hat according to the aforementioned configurations. Additionally, the panel or panels to which the logo is attached can be thicker than the panels to which the logo is not attached, to increase stability.

In another aspect, the present invention is directed to a hat wherein the interchangeable logo comprises various geometrical shapes, including but not limited to, circular, ovular, triangular, square, rectangular, hexagonal, pentagonal, octagonal and rhomboidal, or any combination of these. The logo can also be comprised of a shape that is irregular or abstract, including, but is not limited to, a star, heart, diamond, crescent, wedge, or any combination of these. The logo can also be comprised of various combinations of colors, fabrics, or materials that are the same as or distinct from the materials of which the hat is constructed. In one embodiment, the logo can be comprised of a tab located on the inside of the logo, wherein the tab can facilitate the removal of the logo from the hat, as well as storage of the logo when not attached to the hat. For example, the tab can be a loop wherein the wearer's finger can be easily inserted to remove the logo. Such a loop can also facilitate storage (e.g., placement on a hook or keychain).

In another aspect, the present invention is directed to a hat wherein the interchangeable logo comprises an attachment mechanism to facilitate the attachment of the logo to the hat. For example, the attachment mechanism can be comprised of a seal running along the outer perimeter of the logo that connects to the perimeter of the logo window (i.e., the hole in the hat when no logo is attached). In some embodiments, the seal is constructed such that the interface of the seal connecting the logo and logo window is not visible (i.e., concealed behind the logo window). In some embodiments, the attachment mechanism can include, but is not limited to, a hook and loop mechanism, a rivet mechanism, or a button mechanism. The attachment mechanism can also be such that only the pressure generated by the wearer's finger is required to attach the logo to the hat. In other embodiments, the attachment mechanism can be visible to the viewer or be part of the aesthetic appeal of the logo or hat. In other embodiments, the logo and the attachment mechanism comprise two distinct parts, such that they are both required for attachment to the hat. Alternatively, the logo and attachment mechanism can be combined into a single part that attaches to the hat.

In yet another aspect, the present invention can be directed to a method for changing a logo appearance on a baseball cap. The method can comprise the step of removing a first interchangeable logo from the baseball cap. The method can further comprise the step of selecting a second interchangeable logo having a desired logo symbol. The method can further comprise attaching the second interchangeable logo to the baseball cap. The steps of removing and attaching can further comprise selecting removing and attaching using an attachment mechanism for removing and attaching the first and second interchangeable logos to a logo window on the baseball cap.

In another aspect, the present invention can comprise a hat including a logo window and two or more logos, wherein each logo can be selectively attached and removed from the logo window based upon the desire of a wearer.

In yet another aspect, the present invention can comprise a hat having a logo window and attachable logos that are interconnected so as to preserve the look and feel of a traditional baseball cap and maximizes the aesthetic integrity of the baseball cap. Generally, the look, feel and aesthetics can be maintained by utilizing an attachment mechanism on an interior portion of the baseball hat that is unseen or non-viewable from an exterior of the hat. The attachment mechanism can include a male-female connection that allows the attachable logo to attach from the inside towards the outside, thus providing a smooth aesthetic transition minimizing the appearance of the attachable logo on the hat. In some embodiments, the attachable logos project outward through the logo window so as to appear to be integral and permanently connected to the baseball hat.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be more completely understood in consideration of the following detailed description of various embodiments of the invention in connection with the accompanying drawings, in which.

Figure 1:
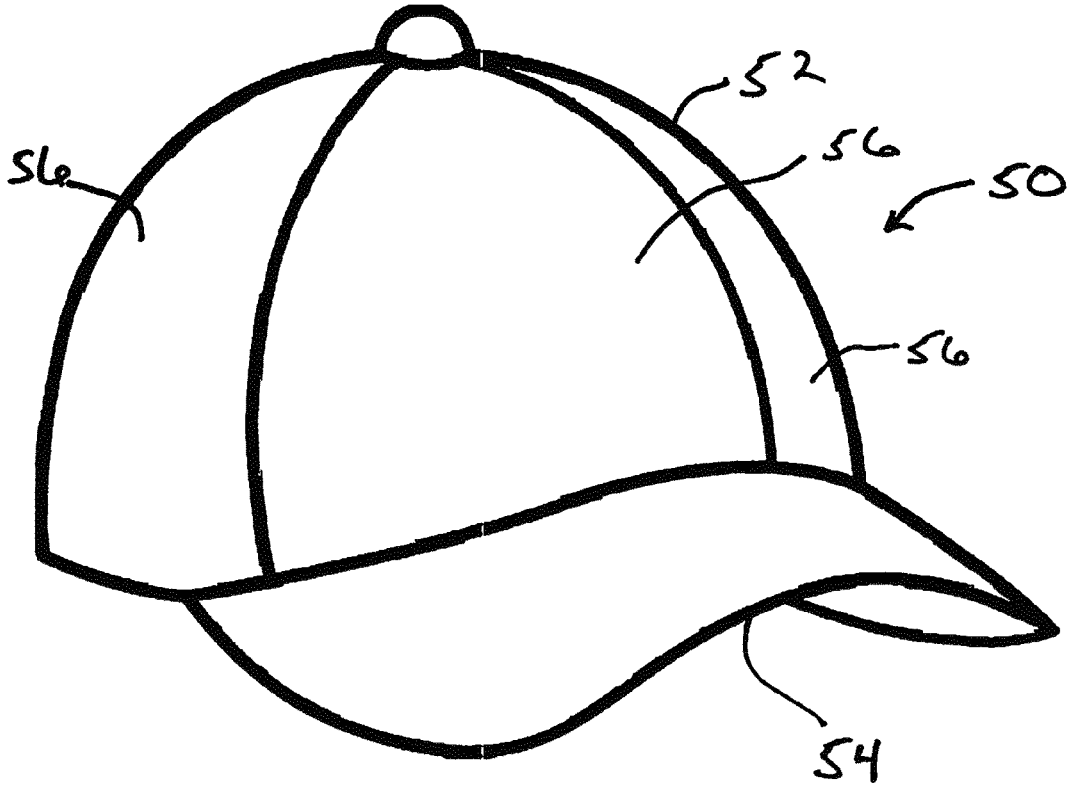
PRIOR ART Fig. 1
FIG. 1 is a front perspective view of a baseball style cap of the prior art.

While the invention is amenable to various modifications and alternative forms, specifics thereof have been shown by way of example in the drawings and will be described in detail. It should be understood, however, that the intention is not to limit the invention to the particular embodiments as described. On the contrary, the intention is to cover all modifications, equivalents, and alternatives falling within the spirit and scope of the invention as defined by the appended claims.

DETAILED DESCRIPTION OF THE DRAWINGS

Referring now to FIG. 1, a baseball style cap 50 of the prior art generally comprises a head portion 52 and a bill 54. Head portion 52 generally defines an opening upon the bottom allowing for placement of the baseball style cap 50 on the head of a wearer. Head portion 52 can be constructed of one or more panels 56 that can be stitched together. In some embodiments, the head portion 52 can include a closure mechanism at a rear of the head portion that allows a user to adjust the size of the bottom opening. In higher quality "fitted" embodiments, the head portion 52 can be constructed of a plurality of panels 56 that are stitched together so as to define a fixed bottom opening such that a user must select a size that corresponds with their head size. In addition, fitted embodiments can include a liner, for example a buckram or latex liner, within the bill 54 and panels 56 to provide stiffness and a level of rigidity to a fitted baseball style cap 50.

Figure 2:
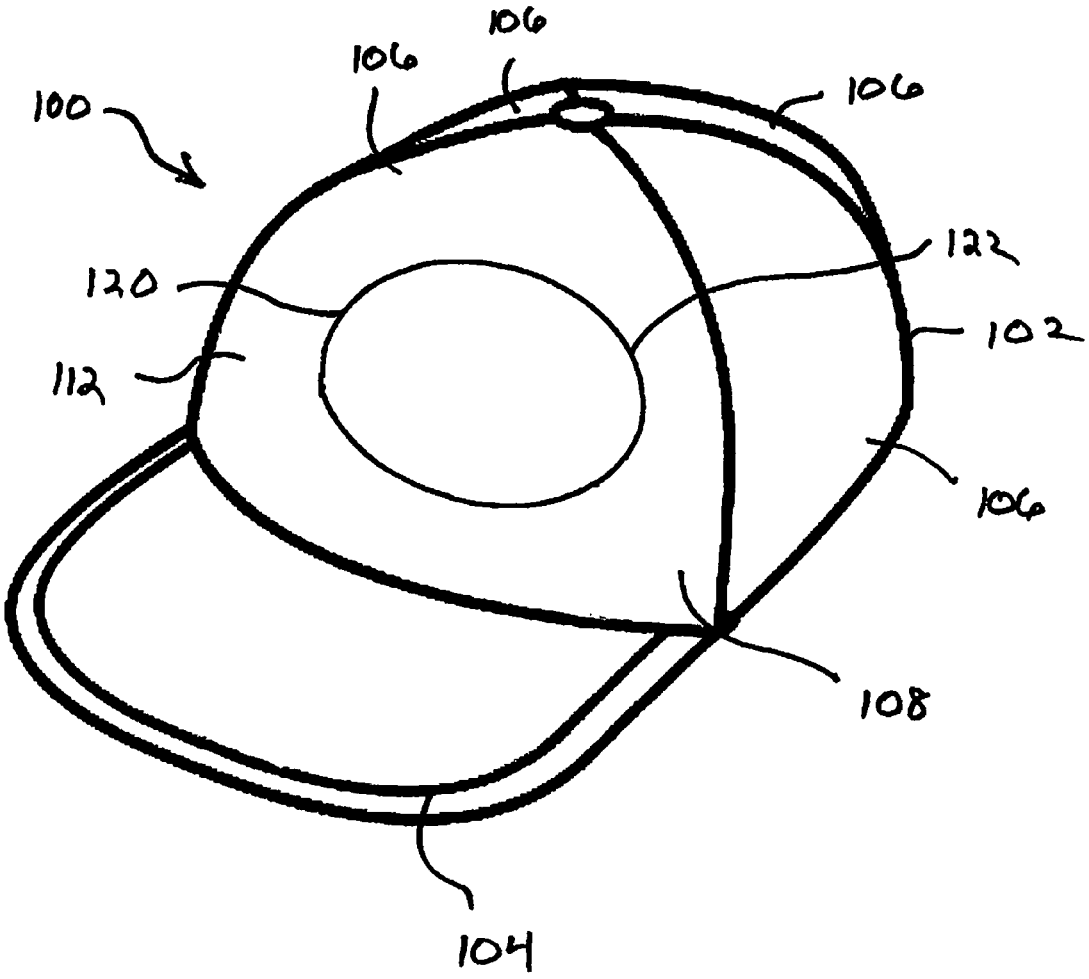
FIG. 2 is a front perspective view of a baseball style cap according to an embodiment of the present invention.
Figure 3:
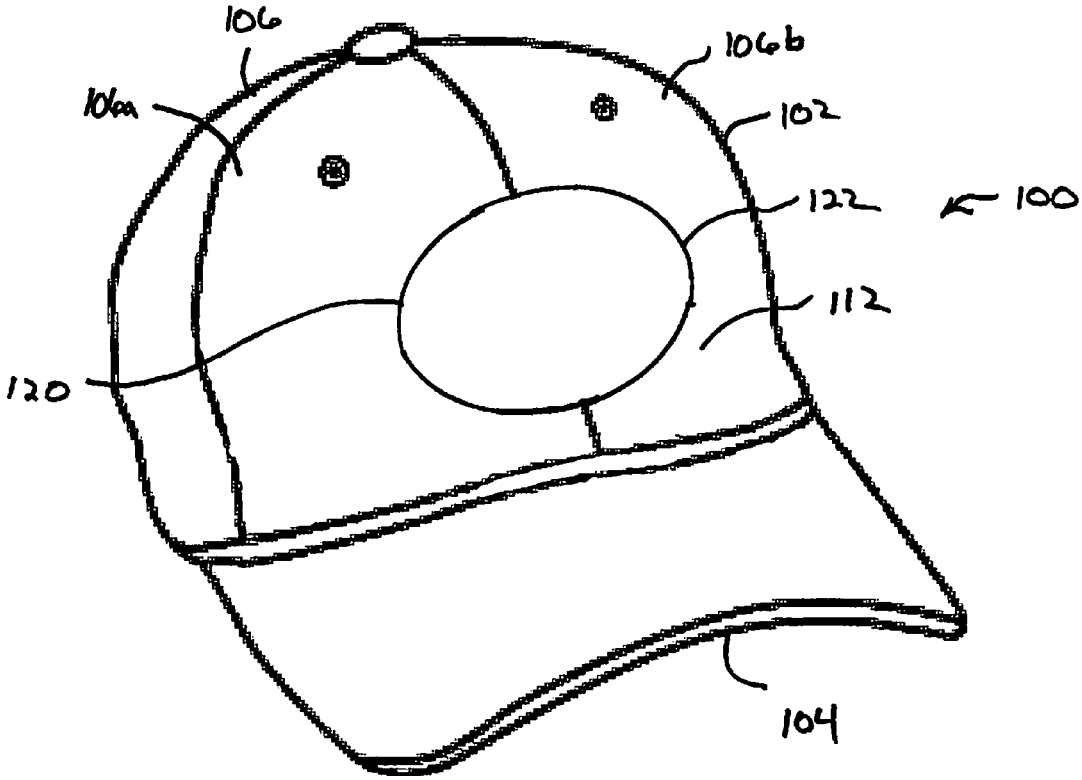
FIG. 3 is a front perspective view of a baseball style cap according to an embodiment of the present invention.
Figure 4:
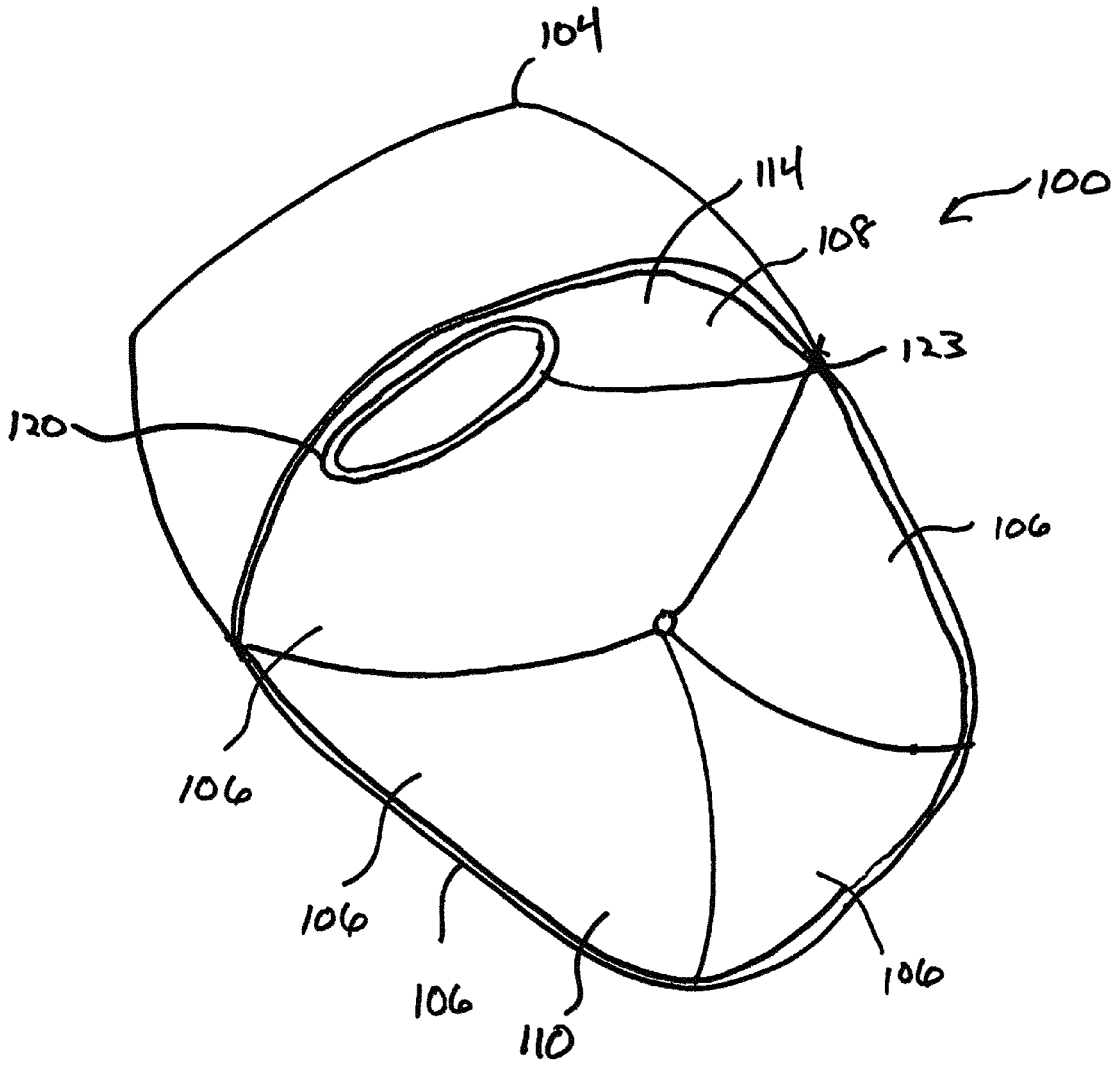
FIG. 4 is a bottom, rear perspective view of a baseball style cap according to an embodiment of the present invention.

As illustrated in FIG. 2, a representative embodiment of a baseball style cap 100 of the present invention can substantially resemble baseball style cap 50 in that cap 100 generally includes a head portion 102 and a bill 104. Head portion 102 is generally formed of a plurality of panels 106 including a front panel 108. In some embodiments, front panel 108 can comprise a single panel 106 or alternatively, a pair of panels 106*a*, 106*b* can cooperatively define the front panel 108 such as shown in FIG. 3. As seen in FIG. 4, head portion 102 further defines a bottom opening 110. As seen in FIGS. 2, 3 and 4, front panel 108 generally includes a front panel surface 112 and a rear panel surface 114. Front panel 108 generally includes a logo window 120. The logo window 120 can be formed of the panel material itself or alternatively, logo window 120 can comprise an oval ring that is partially embedded within partially and overlapped/captured between the front panel surface 112 and rear panel surface 114 as shown as being partially hidden in FIGS. 2, 3, 7, 8 and 11. Logo window 120 generally defines a window perimeter 122 having a rear facing window flange 123. In one representative embodiment, logo window 120 has an oval shape having dimensions such as, for example, 4 inches in width and 3.5 inches in height.

Figure 5:
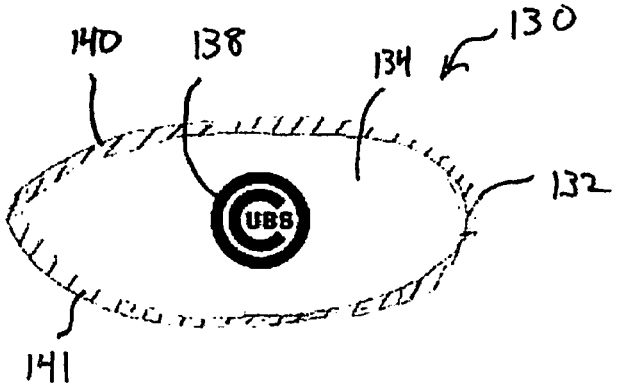
FIG. 5 is a front view of a removable logo according to an embodiment of the present invention.
Figure 6:
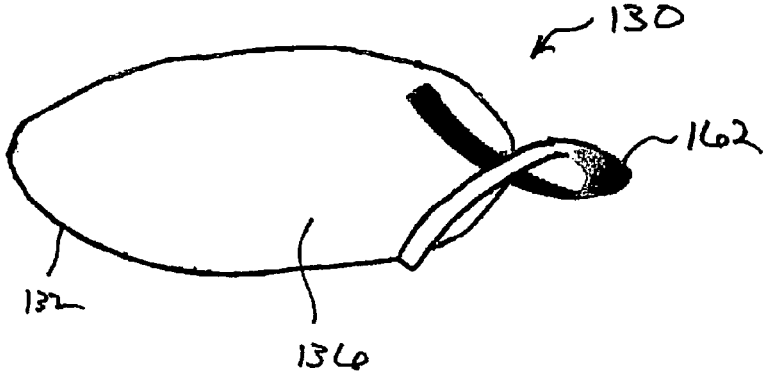
FIG. 6 is a rear view of the removable logo of FIG. 5 according to an embodiment of the present invention.

As illustrated in FIGS. 5 and 6, a removable logo 130 generally comprises a logo body 132 having a front surface 134 and a rear surface 136. Front surface 134 generally includes a logo symbol 138 that will be visible to individuals observing a wearer of the cap 100. Logo symbol 138 can include depictions of characters, symbols, text and the like. Logo symbol 138 can often include characters, symbols or text that are readily associated with and recognized as being synonymous with sports teams, educational institutions, companies, organizations, recreational pursuits, national and international symbols, famous individuals or groups or other recognizable brands or emblems. Logo body 132 generally defines a body perimeter 140 including a forward facing logo flange 141. Body perimeter 140 can generally resemble but is slightly oversized with respect to window perimeter 122. Generally, the front surface 134 will comprise materials similar to or the same as those used in constructing head portion 52 of the baseball style cap 50.

Figure 7:
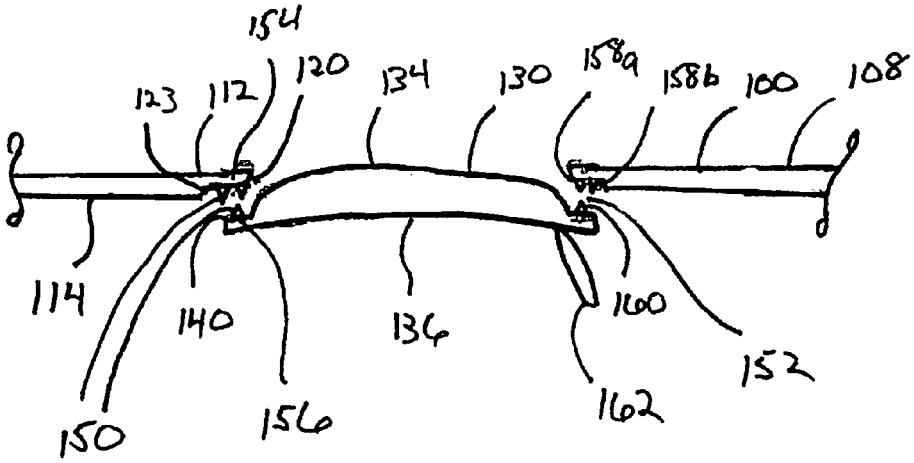
FIG. 7 is a section view of an attachment mechanism for connecting a baseball style cap and a replacement logo according to an embodiment of the present invention.

Removable logo 130 generally mounts within the logo window 120 using an attachment mechanism 150 as illustrated in FIG. 7. In one preferred embodiment, the attachment mechanism 150 can comprises a "Ziploc"-style seal 152 in which a window seal 154 and a logo seal 156 interact to mount retain the removable logo 130 over the logo window 120. Logo window 120, window seal 154 and logo seal 156 can be constructed of suitable materials such as, for example, plastics and or silicone. As seen in FIG. 6, window seal 154 can comprise a pair of spaced apart sealing ridges 158*a*, 158*b* that are mounted on the window flange 123 and reside in proximity to the window perimeter 122. Logo seal 156 can include a single insertion member 160 on the logo flange 141 and is located in proximity to the perimeter 140. In order to attach the removable logo, the wearer simply directs the removable logo 130 through the bottom opening 110 such that the front surface 134 is in proximity to the logo window 120. The user then directs the front surface 134 through the logo window 120 until the insertion member 160 is positioned proximate the sealing ridges 158*a*, 158*b*. The wearer then simply presses the removable logo and head portion 102 towards each other such that the insertion member 160 slides into and is retained by sealing ridges 158*a*, 158*b*. With the insertion member 160 engaged with the sealing ridges 158*a*, 158*b*, the removable logo is sealingly attached and retained to the head portion 102 with the benefit that any observer can now see and recognize the logo symbol 130 without seeing the attachment mechanism 150. When the wearer desires to remove the removable logo 130, the wearer simply grasps a tab 162 on the rear surface 136 of the removable logo 130 and pulls the removable logo 130 away from the head portion 102 such that the insertion member 160 is withdrawn from between the sealing ridges 158*a*, 158 and the removable logo 130 is detached from the logo window 120. As such, baseball style cap 100 has the same appearance as baseball cap 50, but now with an ability to alter its appearance through the use of the removable logo 130.

Figure 8:
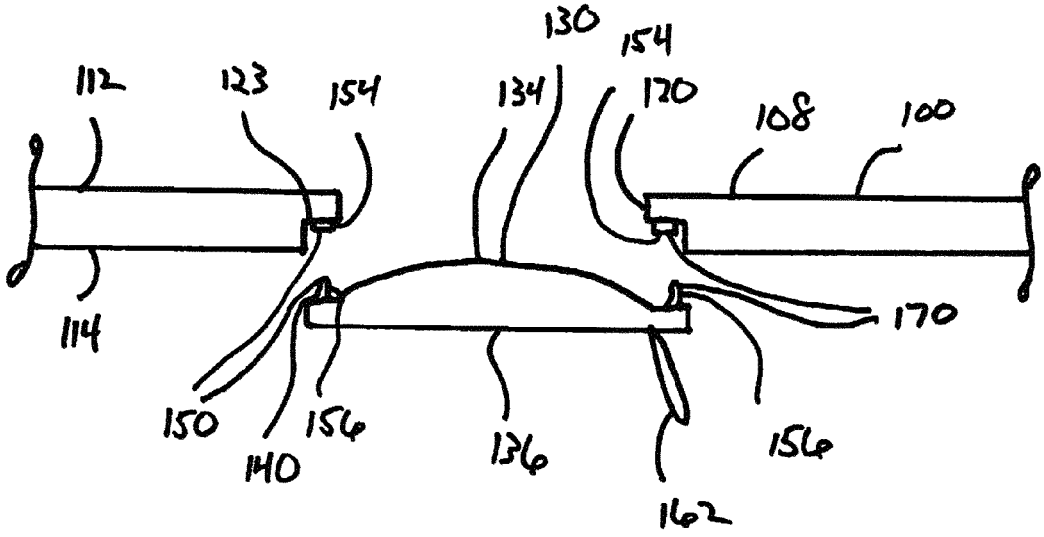
FIG. 8 is a section view of an attachment mechanism for connecting a baseball style cap and a replacement logo according to an embodiment of the present invention.
Figure 9:
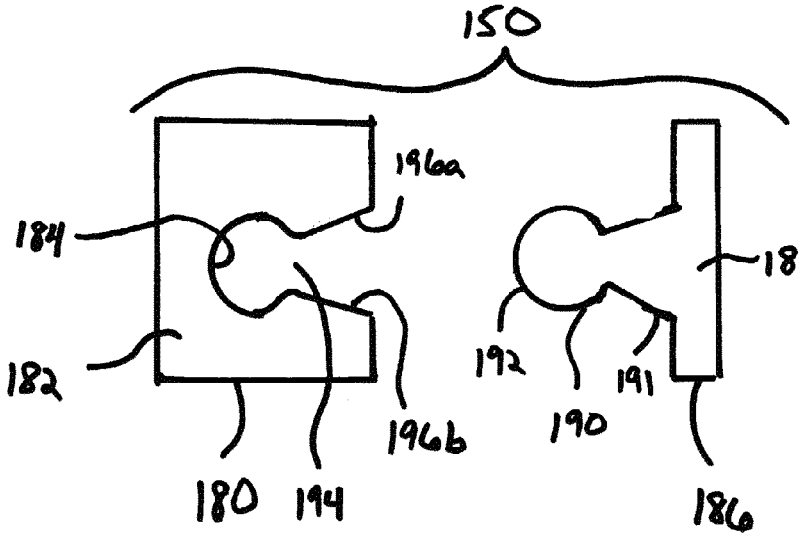
FIG. 9 is a section view of an attachment mechanism for connecting a baseball style cap and a replacement logo according to an embodiment of the present invention.

Attachment mechanism 150 can comprise a variety of alternative attachment means including, for example, a hook and loop mechanism, a rivet mechanism, a button mechanism, a snap mechanism 170 as illustrated in FIG. 8. As illustrated in the section view of FIG. 9, attachment mechanism 150 can include a window seal 180 having a window seal body 182 defining a female receiving cavity 184. Attachment mechanism 150 can further include a logo seal 186 having a logo seal body 188 that includes a male insertion member 190. Male insertion member 190 can include a neck portion 191 and an insertion end 192 that is oversized with respect to an opening 194 of the female receiving cavity 184. The window seal body 182 can be constructed to include a pair of opening sides 196*a*, 196*b* that can be biased apart to increase the size of the opening 194 as the insertion end 192 is introduced into the opening 194 such that the insertion end 192 can be advanced into the female receiving cavity 184. As the insertion end 192 enters the female receiving cavity 184, the opening sides 196*a*, 196*b* return to their original orientation defining the opening 194 such that the opening sides 196*a*, 196*b* are proximate the neck portion 191 and insertion end 192 is captured within the female receiving cavity 184.

As illustrated in FIGS. 2-6, logo window 120 and removable logo 130 can have a substantially oval shape. In alternative embodiments, the geometric shape of logo window 120 and removable logo 130 can be circular, triangular, square, rectangular, hexagonal, pentagonal, octagonal and rhomboidal, or any combination of these without departing from the spirit and scope of the present invention. In addition, removable logo 130 can be fabricated of any variety of colors, fabrics, polymers or other materials that can be the same as or distinct from the materials of which front panel 108 or other parts of baseball cap 100 is constructed.

Figure 10:
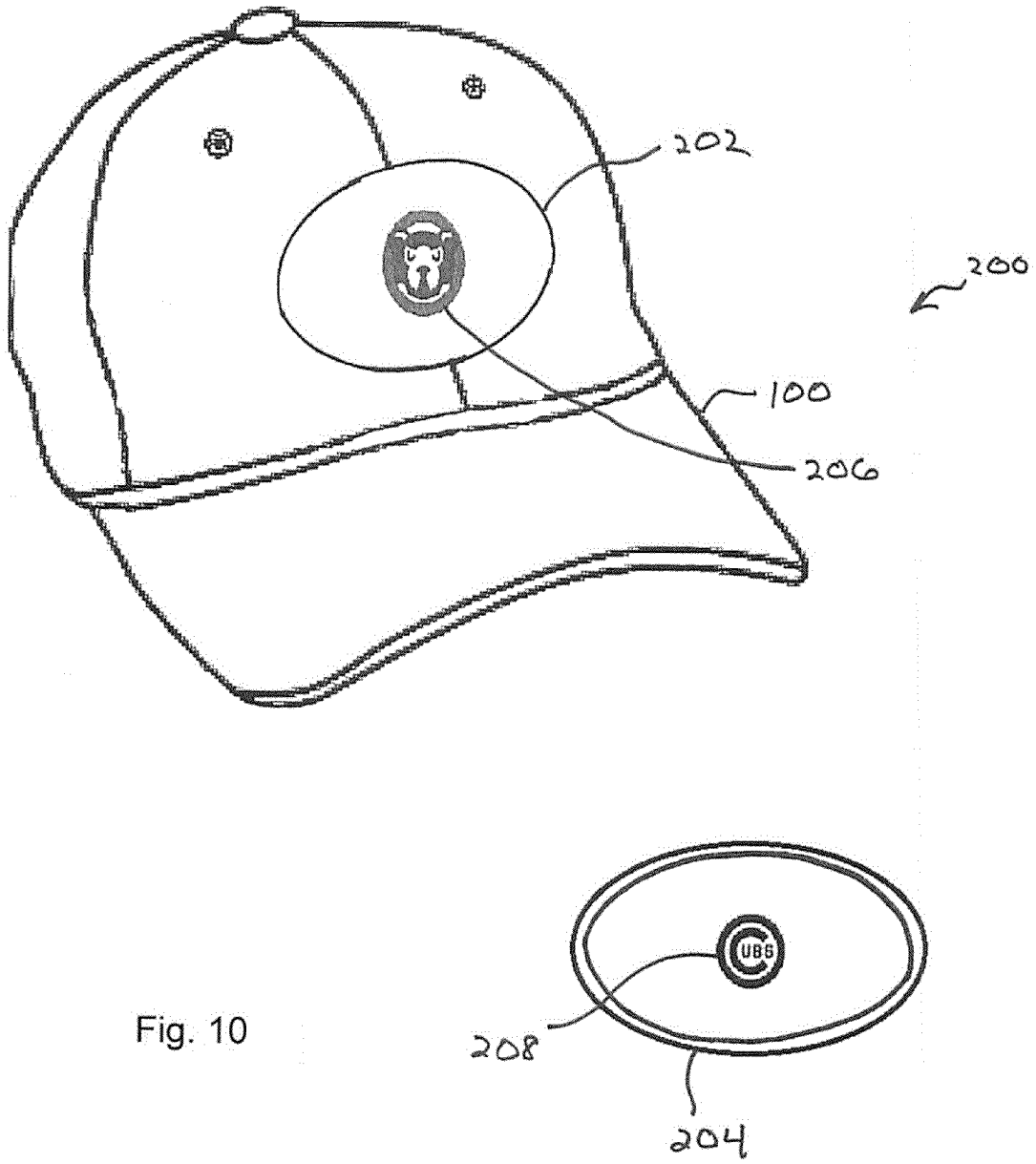
FIG. 10 is a front perspective view of a baseball style cap system according to an embodiment of the present invention.

As illustrated in FIG. 10, a baseball cap system 200 according to an embodiment of the present invention can comprise baseball cap 100, a first removable logo 202 and a second removable logo 204. First removable logo 202 and second removable logo 204 can be structurally identical to removable logo 130 and can be selectively attached and detached to baseball cap 100 as previously described with respect to removable logo 130. First removable logo 202 can have a first logo symbol 206 that is different from a second logo symbol 208 on the second removable logo 204. Baseball cap system 200 thus allows a wearer to choose which of first logo symbol 206 or second logo symbol 208 that the wearer chooses to display. In this way, the user can choose between displaying certain colors, characters or text, for example, based on which uniform a favorite team is wearing. In addition to first removable logo 202 and second removable logo 204, the wearer can have any number of additional removable logos that are interchangeable with the baseball cap 100 so as to provide ultimate functionality to the baseball cap system 200. When an extra removable logo is not being utilized in conjunction with the baseball cap 100, tab 162 provides an ability to store the extra removable logo on a hook or even to attach a key ring such that the extra removable logo is still carried by the wearer.

Figure 11:
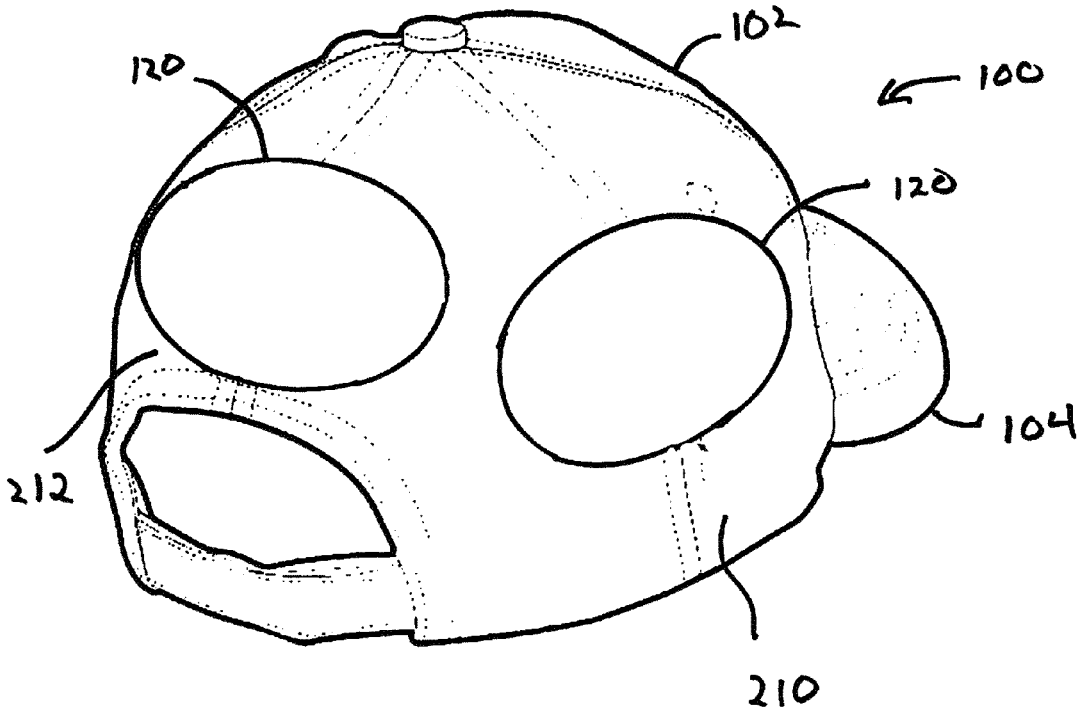
FIG. 11 is a rear perspective view of a baseball style cap according to an embodiment of the present invention.

In some alternative embodiments, baseball cap 100 can include additional removable logos for example by including logo window 120 on a side panel 210 or rear panel 212 as shown in FIG. 11. Side panel 210 and rear panel 212 can be fabricated in a similar manner as previously described with respect to front panel 108. In addition, removable logos can be utilized with other articles of clothing such as, for example, belts, belt buckles, shoes, purses, bags backpacks, jackets and the like that have similarly constructed logo windows.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

What is claimed is:

1. A hat comprising:

a head portion having one or more panels, wherein each panel includes a front panel surface, a rear panel surface and at least one window defining an opening from the front panel surface to the rear panels surface and wherein the window defines a window perimeter having a rear facing window flange; and a removable logo having a logo body defining a front logo surface and a rear logo surface, the logo body defining a logo perimeter having a forward facing logo flange, wherein the logo body is positioned such that the front logo surface projects through the opening from the rear panel surface to the front panel surface and the forward facing logo flange interfaces with the rear facing window flange to attach the removable logo to the head portion.

2. The hat of claim 1, further comprising:

a second removable logo having a second logo body defining a second front logo surface and a second rear logo surface, the second logo body defining a second logo perimeter having a second forward facing logo flange, wherein the removable logo is detached and removed from the head portion and wherein the second logo body is positioned such that the second front logo surface projects through the opening from the rear panel surface to the front panel surface and the second forward facing logo flange interfaces with the rear facing window flange to attach the second removable logo to the head portion.

3. The hat of claim 1, wherein the rear facing window flange includes a window seal and the forward facing logo flange includes a logo seal, wherein the window seal and the logo seal are engageable to attach the removable logo to the head portion.

4. The hat of claim 3, wherein the window seal comprises a pair of spaced apart sealing ridges and the logo seal includes an insertion member, and wherein the insertion member is inserted between the spaced apart sealing ridges to engage the window seal and the logo seal.

5. The hat of claim 3, wherein the window seal includes a female receiving cavity and the logo seal includes a male insertion member, and wherein the male insertion member is inserted into the female receiving cavity to engage the window seal and the logo.

6. The hat of claim 1, wherein the head portion further comprises a second window defining a second opening.

7. The hat of claim 1, wherein the logo body further comprises a tab attached to the rear logo surface, wherein manipulation of the tab allows for removal of the removable logo from the head portion.

8. The hat of claim 7, wherein the tab defines a loop such that the loop can be stored when the removable logo is detached from the head portion.

9. A method for altering a hat's appearance, the method comprising:

positioning a removable logo inside a head portion of a hat such that a front logo surface projects through an opening defined in a hat panel; and attaching the removable logo to the hat panel by engaging a forward facing logo flange on the removable logo with a rear facing window flange surrounding the opening.

10. The method of claim 9, wherein the forward facing logo flange includes a logo seal and where the rear facing window flange includes a window seal and wherein the step of attaching the removable logo to the hat panel further comprises:

engaging the logo seal and the window seal.

11. The method of claim 10, wherein the logo seal includes an insertion member and the window seal includes a pair of spaced apart sealing ridges and wherein the step of engaging the logo seal and the window seal further comprises:

capturing the insertion member between the pair of spaced apart sealing ridges.

12. The method of claim 10, wherein the logo seal includes a male insertion member and the window seal includes a female receiving cavity and wherein the step of engaging the logo seal and the window seal further comprises:

inserting the male insertion member into the female receiving cavity.

13. The method of claim 9, further comprising:

removing the removable logo from the opening; and positioning a second removable logo inside the head portion of the hat such that a second front logo surface projects through the opening; and attaching the second removable logo to the hat panel by engaging a second forward facing logo flange on the second removable logo with the rear facing window flange surrounding the opening.

14. The method of claim 13, wherein the removable logo further comprises a tab attached to a rear logo surface of the removable logo and wherein the step of removing the removable logo from the opening, further comprises:

grasping the tab; and pulling the tab to disengage the forward facing logo flange and the rear facing window flange.

15. The method of claim 14, further comprising:

storing the removable logo by hanging the removable logo using the tab.

16. A hat comprising:

a head portion having one or more panels, wherein each panel includes a front panel surface, a rear panel surface and at least one window defining an opening from the front panel surface to the rear panels surface and wherein the window defines a window perimeter having a rear facing window flange including a window seal; and a removable logo having a logo body defining a front logo surface and a rear logo surface, the logo body defining a logo perimeter having a forward facing logo flange including a logo seal, wherein the logo body is positioned such that the front logo surface projects through the opening from the rear panel surface to the front panel surface and the logo seal engages the window seal to attach the removable logo to the head portion.

17. The hat of claim 16, wherein the window seal comprises a pair of spaced apart sealing ridges and the logo seal includes an insertion member, and wherein the insertion member is inserted between the spaced apart sealing ridges to engage the window seal and the logo seal.

18. The hat of claim 16, wherein the window seal includes a female receiving cavity and the logo seal includes a male insertion member, and wherein the male insertion member is inserted into the female receiving cavity to engage the window seal and the logo.

19. The hat of claim 16, further comprising:

a second removable logo having a second logo body defining a second front logo surface and a second rear logo surface, the second logo body defining a second logo perimeter having a second forward facing logo flange including a second logo seal, wherein the removable logo is detached and removed from the head portion and wherein the second logo body is positioned such that the second front logo surface projects through the opening from the rear panel surface to the front panel surface and the second logo seal engages the window seal to attach the second removable logo to the head portion.

20. The hat of claim 16, wherein the logo body further comprises a tab attached to the rear logo surface, wherein manipulation of the tab allows for removal of the removable logo from the head portion.

* * * * *